US009455096B2

(12) United States Patent
Chen

(10) Patent No.: US 9,455,096 B2
(45) Date of Patent: Sep. 27, 2016

(54) KEY MODULE AND KEYBOARD HAVING THE SAME

(71) Applicants: LITE-ON ELECTRONICS (GUANGZHOU) LIMITED, Guangzhou (CN); LITE-ON TECHNOLOGY CORPORATION, Taipei (TW)

(72) Inventor: Chun-Lin Chen, New Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 10 days.

(21) Appl. No.: 14/263,198

(22) Filed: Apr. 28, 2014

(65) Prior Publication Data

US 2015/0101916 A1 Apr. 16, 2015

(30) Foreign Application Priority Data

Oct. 16, 2013 (CN) ..... 2013 1 0485476

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 3/12*** | (2006.01) |

(52) U.S. Cl.

CPC ..... *H01H 3/125* (2013.01)

(58) Field of Classification Search

CPC ..... H01H 1/00; H01H 1/12; H01H 1/22; H01H 1/221; H01H 1/225; H01H 3/00; H01H 3/02; H01H 3/12; H01H 13/00; H01H 13/02; H01H 13/70; H01H 13/12; H01H 13/20; H01H 13/50; H01H 13/7006; H01H 13/705; H01H 13/86; H01H 2003/00; H01H 2003/02; H01H 2003/12; H01H 2201/00; H01H 2219/036; H01H 2233/033; H01H 21/36; H01H 36/004; H01H 2221/00

USPC ..... 200/5 A, 5 R, 46, 406, 511–514, 200/520–521, 308, 310–314, 317, 337, 341, 200/345

See application file for complete search history.

(56) References Cited

U.S. PATENT DOCUMENTS

| | | | | |
|---|---|---|---|---|
| 5,488,210 | A † | 1/1996 | Shigetaka | |
| 6,020,565 | A † | 2/2000 | Pan | |
| 6,133,538 | A * | 10/2000 | Hsu | 200/344 |
| 8,957,337 | B2 * | 2/2015 | Niu | 200/344 |
| 2011/0011713 | A1 † | 1/2011 | Su | |
| 2012/0048702 | A1 * | 3/2012 | Liu | 200/5 A |

* cited by examiner
† cited by third party

*Primary Examiner* — Renee Luebke
*Assistant Examiner* — Anthony R. Jimenez
(74) *Attorney, Agent, or Firm* — Li & Cai Intellectual Property (USA) Office

(57) ABSTRACT

A key module and a keyboard having the key module are provided. The key module includes a base, a scissor-type unit and a keycap. The scissor-type unit has a first frame and a second frame. The first frame has a connection shaft rotatably pivotally connected to a shaft hole of the second frame. The shaft hole has a travel distance therein for the shaft to move within the shaft hole along a predetermined direction. The first and second frames respectively have a first side pivotally connected to a pivot connection unit of the key cap, and a second side slidably connected to a restricting unit of the base. Through the above-mentioned design, the first frame can rotate with respect to the second frame, so that the keycap can move up and down with respect to the base.

5 Claims, 11 Drawing Sheets

KEY MODULE AND KEYBOARD HAVING THE SAME

BACKGROUND OF THE INVENTION

1. Field of the Invention

The present disclosure relates to a key module and a keyboard having the same; in particular, to a key module which evenly supports a keycap while preventing tilting of the keycap and is suitable for slim keyboards, and a slim keyboard having the same.

2. Description of Related Art

The demand for slim computers (e.g. laptops) calls for keyboards using scissor-type structures which guides the up and down movement of the keycaps and balances the force applied by the user on each key. As shown in FIG. 1, the keycap 10 of a conventional key structure 1 has a first sliding joint 101 and a first pivot joint 102. The base 20 has a second sliding joint 201 and a second pivot joint 202. Scissor structure 30 (scissor switch) includes a first support unit 301 and a second support unit 302. The first support unit 301 is pivotally connected to the second support structure 302. The first support structure 301 has a first sliding portion 303 and a first pivot shaft 304. The second support unit 302 has a second sliding portion 305 and a second pivot shaft 306. The first sliding portion 303 can be slidably disposed in the first sliding joint 101, and the first pivot shaft 304 can rotatably pivot about the second pivot joint 202. The second sliding portion 305 can be slidably disposed in the second sliding joint 201, and the second pivot shaft 306 can rotatably pivot about the first pivot joint 102. In other words, the keycap 10 has a fixed end E1 (corresponding to the side of the scissor structure 30 having the first pivot shaft 304 and the second pivot shaft 306) and a sliding end E2 (corresponding to the side of the scissor structure 30 having the first sliding portion 303 and the second sliding portion 305.

As shown in FIG. 1A, when the sliding end E2 of the keycap 10 is pressed, the sliding end E2 moves an ineffective transverse distance along the first sliding joint 101 (as shown by arrow M11) and an ineffective vertical distance toward the base 20 (as shown by arrow M12), after which the sliding end E2 moves in conjunction with the scissor structure 30 toward the base 20 in an effective vertical stroke for pressing an elastic body 4. Hence, when the keycap 10 is pressed on one side, the sliding end E2 moves an ineffective distance before moving downward in conjunction with the scissor structure 30, therefore producing an undesired tilting of the sliding end E2 and flipping of the keycap 10. The transverse movement reduces the effective vertical travel distance of the key structure, such that the requirement of small thickness is not met for slim or super slim keyboards. Additionally, given that the force applied on the keycap 10 is not evenly distributed across the entire keycap 10, the key structure easily becomes tilted and unstable, even unable to complete the motion for driving the scissor structure 30, such that the switch cannot be triggered and more noise is created during operation. Moreover, when the conventional key structure 1 is applied on super slim keyboards, given that the ineffective distance of the sliding end E2 of the keycap 10 is overly long, the effective vertical travel distance is insufficient. As a result, electrical conduction is poor and undesirable tilting of corners of the keycap 10 is more serious, rendering the key structure 1 less suitable for super slim keyboards.

Additionally, the current method of assembling keycaps 10 onto scissor structures 30 requires human labor at least two steps. First, the sliding joint 101 of the keycap 10 must couple to the first sliding portion 303 of the scissor structure 30 from a slanted position. Then, the first pivot joint 102 of the keycap 10 must be coupled to the second pivot shaft 306 of the scissor structure 30. As can be seen, using human labor for assembly not only compromises the speed of assembly but also increases the rate of poor assemblies. Additionally, the force of assembly is not easily controlled, which leads to damages to the keycap 10 or the scissor structure 30. Therefore, the assembly of the keycap 10 and the scissor structure 30 requiring human labor cannot be automated and the production speed cannot be increased.

Additionally, as shown in FIG. 2, when the conventional key structure 1 is applied on longer or irregularly shaped keys (e.g. Space, Shift, Backspace and Enter), the unstable scissor structure 30 and the easily tilted keycap 10 lead to lack of rigidity of the key structure 1. Therefore, metal stabilizer links 40 span the majority of the region of the keycap 10 to independently connect to the keycap 10 and the base 20, for increasing the stability of the keycap 10 during up and down motion, and additional metal stabilizer links 40 are disposed at the peripheries of the scissor structures 30 for solving the problem of tilting and instability of the key structure 1. As shown in FIG. 2, five metal stabilizer links 40 are used. Given that the metal stabilizer links 40 and the scissor structures 30 are very close to each other, assembly of the key caps 10 of the key structure 1 is more difficult. Moreover, given the same size of the keycap 10, the conventional scissor structure 30 must be smaller in order to free up sufficient space to accommodate metal stabilizer links 40, exacerbating the problem of insufficient rigidity of the scissor structure 30 and the margin of error during production. Additionally, additional metal stabilizer links 40 not only creates serious noise during operation, but also complicates assembly, and increases the rate of poor quality and cost of human labor.

SUMMARY OF THE INVENTION

The main object of the present disclosure is to provide a key module and a keyboard using the same, in particular a key module applicable on super slim keyboards and a super slim keyboard using the same.

A secondary object of the present disclosure is to provide a keycap having four pivot joints each allowing rotational and no translational motion. The pivotal connections between the keycap and the scissor-type unit form dual fixed-rotation axes effectively reducing lateral movement and simplifying assembly of the keycap which can be automated.

In order to achieve the aforementioned objects, the present disclosure provides a key module including: a base having a restricting unit; a scissor-type unit disposed on and connected to the base, and including a first frame and a second frame, wherein the first frame has a shaft and the second frame has a shaft hole, the first frame is rotatably connected to the second frame through the accommodation of the shaft into the shaft hole, and the shaft hole has a travel distance therein for the shaft to move within the shaft hole along a predetermined direction and a keycap disposed on and connected to the scissor-type unit, and having a pivot connection unit. A first side and a second side of the first frame are respectively rotatably pivoted about the pivot connection unit and slidably disposed at the restricting unit. A first side and a second side of the second frame are respectively rotatably pivoted about the pivot connection unit and slidably disposed at the restricting unit. The first sides of the first frame and the second frame each rotatably pivot about the pivot connection unit, the second sides of the first frame and the second frame are each slidably disposed at the restricting unit, and the shaft moves within the shaft hole, such that the first frame rotates with respect to the second frame so as to move the keycap up and down with respect to the base.

The present disclosure also provides a keyboard, including: a base having a plurality of restricting units; a plurality of scissor-type units disposed on and connected to the base, and each including a first frame and a second frame, wherein each of the first frames has a shaft and each of the second frames has a shaft hole, the first frames are respectively rotatably connected to the second frames through the accommodation of the shafts into the respective shaft holes, and the shaft hole is shaped such that the shaft can travel a travel distance therein along a predetermined direction; a plurality of keycaps respectively disposed on and connected to the scissor-type units, and each having a pivot connection unit, wherein first sides of the first frames are respectively rotatably pivoted about the corresponding pivot connection units, second sides of the first frames are respectively slidably disposed at the corresponding restricting units, first sides of the second frames are respectively rotatably pivoted about the corresponding pivot connection units, and second sides of the second frames are respectively slidably disposed at the corresponding restricting units; a plurality of elastic bodies respectively disposed under the keycaps; and a thin-film printed circuit board disposed on the base and corresponding to the keycaps. The first sides of the first frames and the second frames respectively rotatably pivot about the pivot connection units, the second sides of the first frames and the second frames are respectively slidably disposed at the restricting units, and the shaft moves within the respective shaft holes, such that the first frames respectively rotate with respect to the second frames so as to move the keycaps up and down with respect to the base, and the elastic bodies act in conjunction to contact the thin-film printed circuit board to produce signals.

The present disclosure has the following advantages. Through the travel distance of the shaft in the shaft hole, the respective rotatably pivotal connections of the upper ends of the first and second frames to the pivot connection unit, and the respective slidable arrangement of the lower sides of the first and second frames at the restricting unit, the keycap can promptly drive the first frame and the second frame to move together toward the base an effective vertical travel distance, achieving the effect of moving the keycap up and down relative to the base within a small range.

Additionally, the scissor-type unit of the key module of the present disclosure can have forces evenly distributed across the entire keycap, such that the keycap not only directly moves toward the base an effective vertical travel distance (without or almost without an ineffective travel distance), but also increases the rigidity of the key module because the keycap is less easily tilted. Hence, the amount of necessary stabilizer links is reduced, thereby lowering the difficulty of assembly of the key module. Additionally, the central region, the periphery or any position of the keycap have uniform rigidity and resilience to touch and press.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Unless otherwise specified, the present disclosure is not limited to any mention of quantities or the like in the following description of embodiments. The details disclosed herein are not limiting and serve only as a basis of the application scope and as an exemplary basis for teaching someone skilled in the art to apply the present disclosure in any form or method, including using the features disclosed herein or possible undisclosed combinations thereof. Additionally, languages referring to directions such as left, right, front and rear, etc. refer only to the directions in the figures and serve as descriptions instead of limitations of the present disclosure. A key module 100 of the present disclosure can be applied to super slim keyboards. The following descriptions use examples of the key module 100 applied on super thin keyboards.

Figure 3:
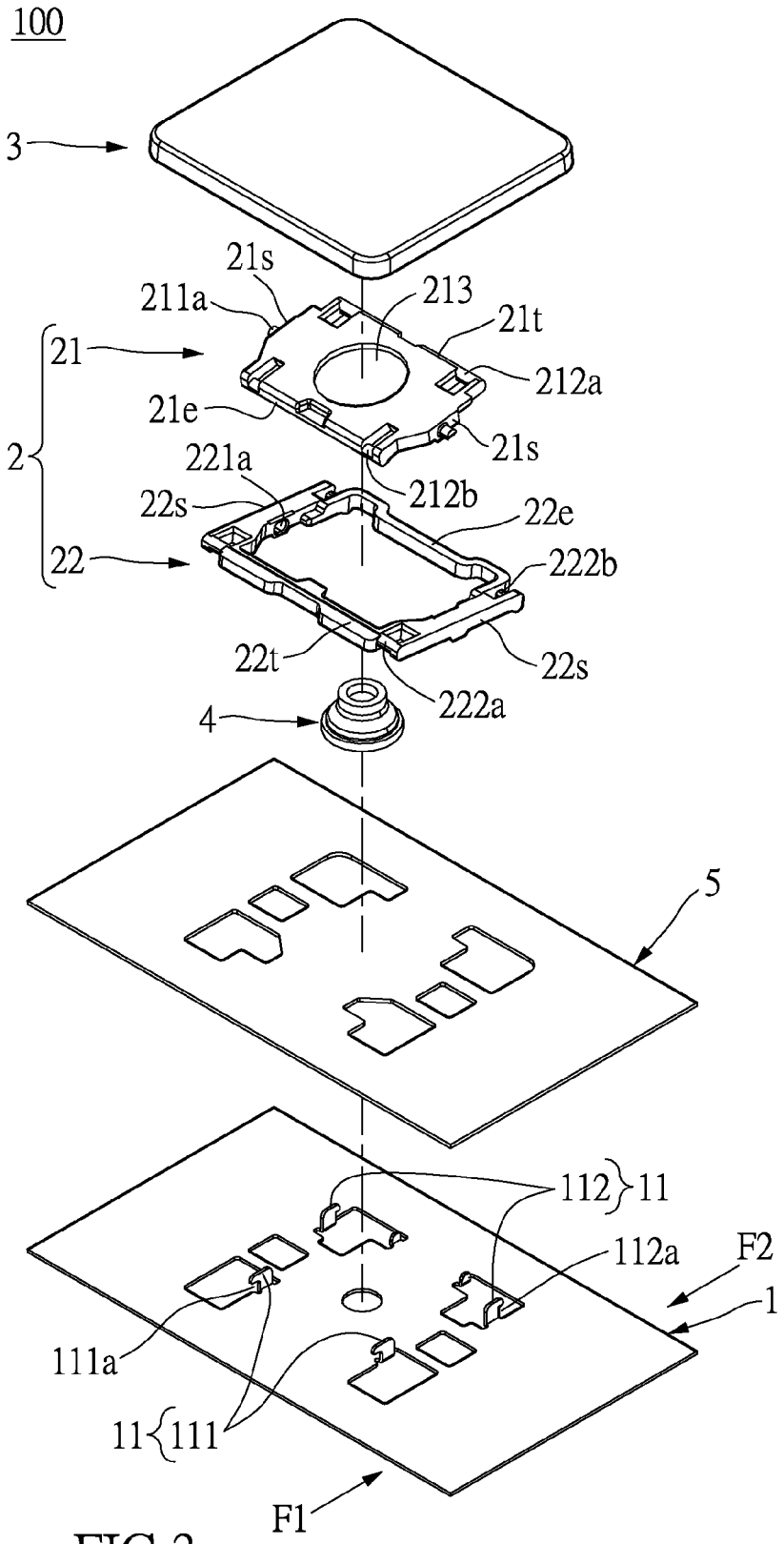
FIG. 3 shows an exploded view of a key module according to the present disclosure.
Figure 4:
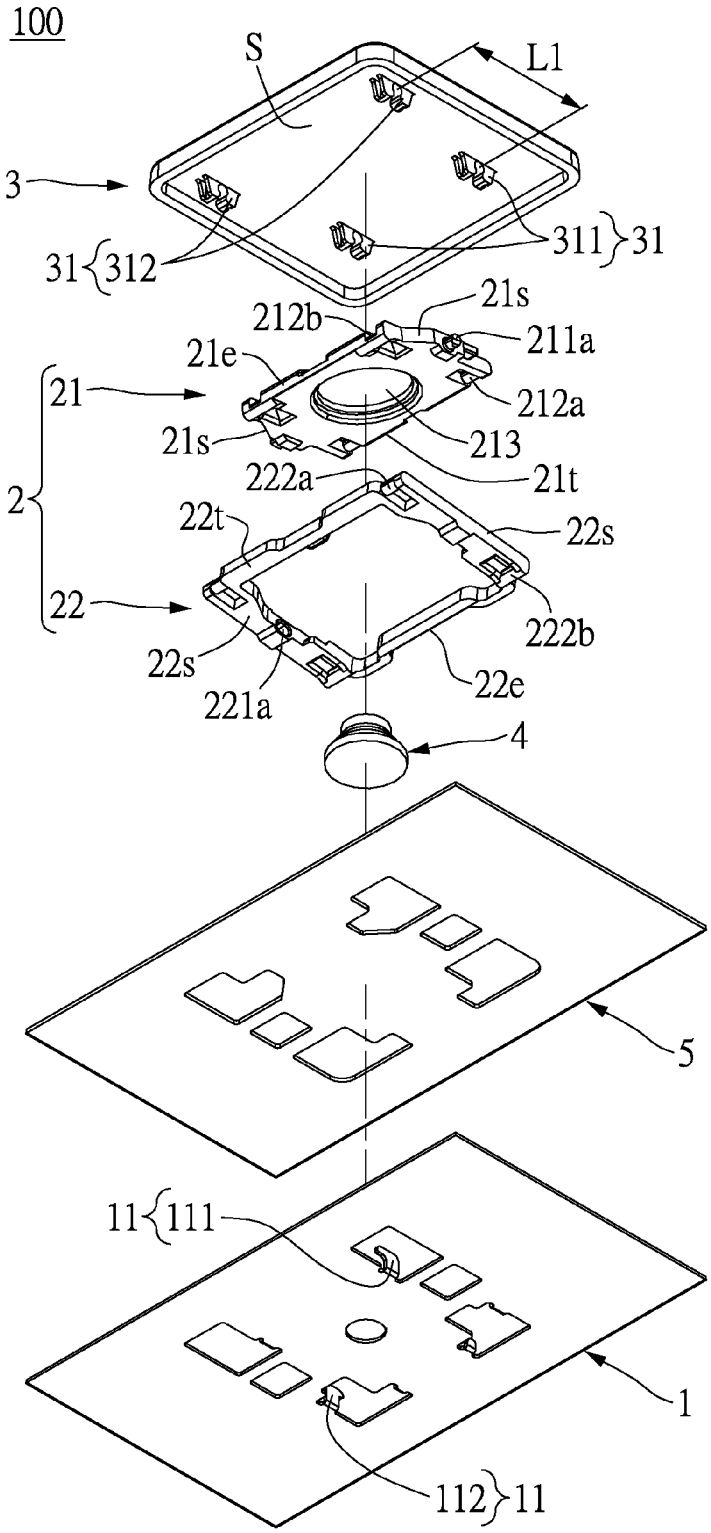
FIG. 4 shows an exploded view of a key module according to the present disclosure from another perspective.
Figure 5:
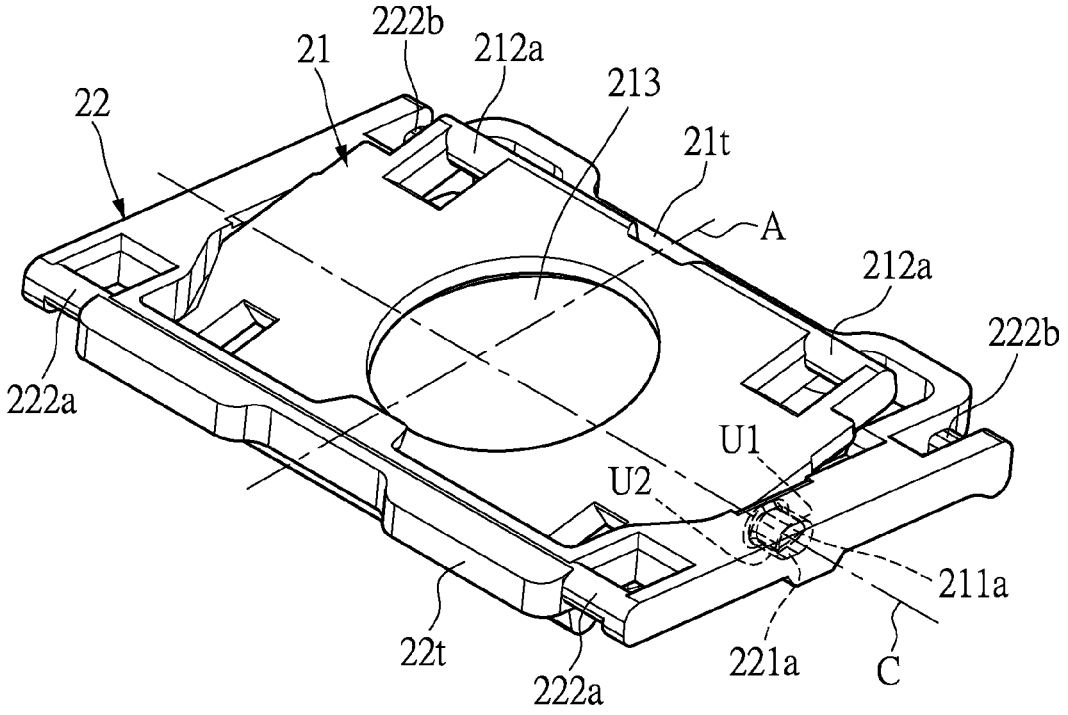
FIG. 5 shows a perspective view of an assembled scissor-type unit according to the present disclosure.

Referring to FIG. 3 to FIG. 5, the present disclosure provides a key module 100 including a base 1, a scissor-type unit 2 and a keycap 3. As shown in FIG. 3 and FIG. 4, the scissor-type unit 2 is disposed on and connected to the base 1, and the keycap 3 is disposed on and connected to the scissor-type unit 2. The scissor-type unit 2 includes a first frame 21 and a second frame 22 assembled to form an X shape (as shown in FIG. 5). The first frame 21 has a connection shaft 211*a*, and the second frame 22 has a shaft hole 221*a*. Through the accommodation of the connection shaft 211*a* in the shaft hole 221*a*, the first frame 21 is rotatably connected to the second frame 22. Preferably, the shaft hole 221*a* is an elongated groove which can guide the connection shaft 211*a* to travel with substantially one degree of freedom. The shaft hole 221*a* has a first contact face U1 and a second contact face U2 opposite each other. The connection shaft 211*a* can travel between the first contact face U1 and the second contact face U2.

Figure 6:
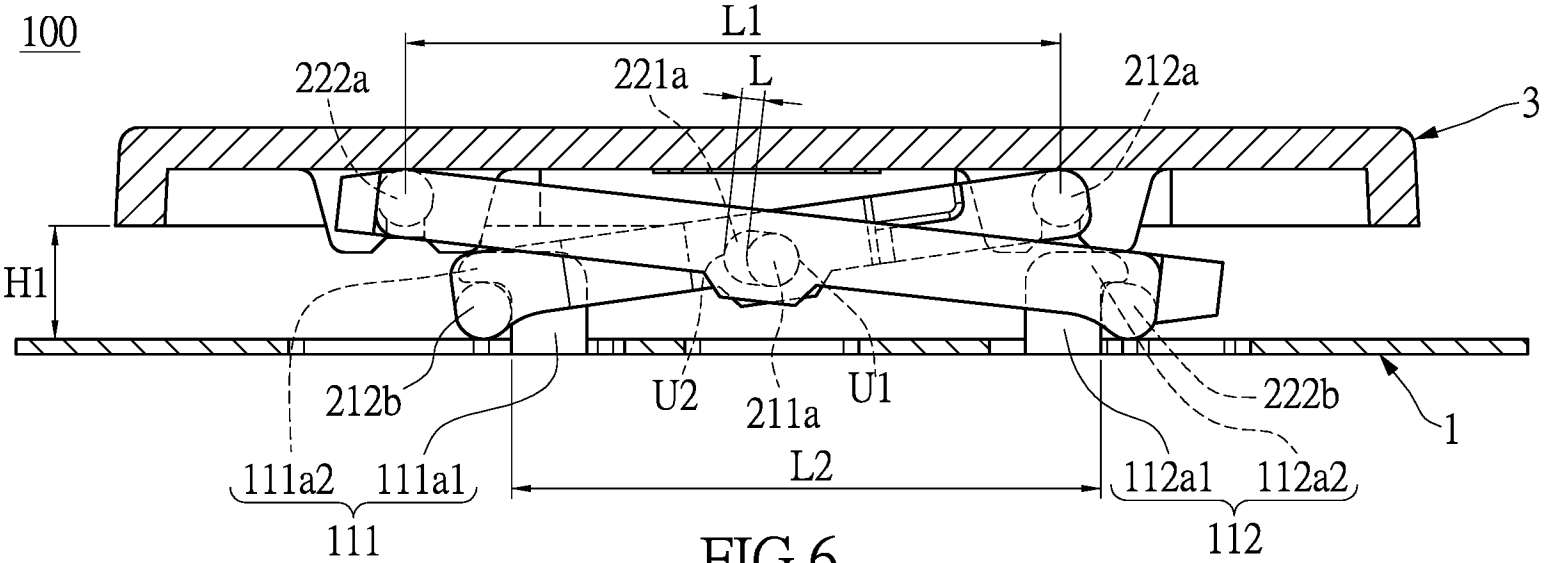
FIG. 6 shows a schematic diagram of a key module prior to being pressed according to the present disclosure.
Figure 7:
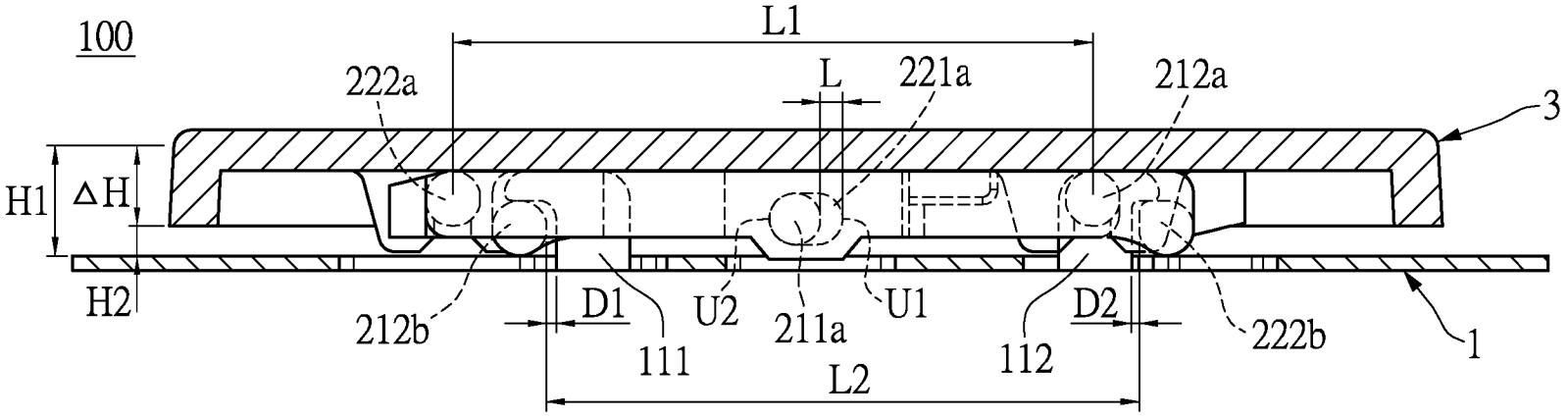
FIG. 7 shows a schematic diagram of a key module after being pressed according to the present disclosure.

As shown in FIG. 4, the base 1 may be made of metal or other suitable materials, and has a restricting unit 11; the keycap 3 has a pivot connection unit 31; a first side 21*t* (the upper side) and a second side 21*e* (the lower side) of the first frame 21 are respectively rotatably pivotally connected to the pivot connection unit 31 and slidably disposed at the restricting unit 11. Likewise, a first side 22*t* (the upper side) and a second side 22*e* (the lower side) of the second frame 22 are respectively rotatably pivotally connected to the pivot connection unit 31 and slidably disposed at the restricting unit 11. Of particular note, given that the first side 21*t* of the first frame 21 pivotally connected to the pivot connection unit 31 and the first side 22*t* of the second frame 22 pivotally connected to the pivot connection unit 31 have a fixed distance L1 therebetween (as shown in FIG. 6 and FIG. 7), and that the second side 21*e* of the first frame 21 slidably disposed at the restricting unit 11 and the second side 22*e* of the second frame 22 slidably disposed at the restricting unit 11 have a variable distance L2 therebetween (as shown in FIG. 6 and FIG. 7), when the key module 100 of the present disclosure is pressed, as shown in FIG. 6 and FIG. 7, the connection shaft 211*a* of the first frame 21 travels between the first contact face U1 and the second contact face U2 . Since the fixed distance L1 is constant, and the variable distance L2 is variable and spans beyond the first sliding connection portions 111 and the second sliding connection portions 112, the keycap 3 stably moves relative to the base 1 in an up and down motion.

Specifically, the connection shaft 211*a* of the first frame 21 can be guided by the shaft hole 221*a* to move with substantially one degree of freedom a travel distance L within the shaft hole 221*a* of the second frame 22. When the keycap 3 is pressed, the connection shaft 211*a* moves a transverse distance within the shaft hole 221*a* (from the first contact face U1 to the second contact face U2), and the second side 21*e* of the first frame 21 slidably disposed at the restricting unit 11 of the base 1 and the second side 22*e* of the second frame 22 slidably disposed at the restricting unit 11 of the base 1 slide further from each other in a transverse direction. These three positions provide the necessary transverse movement for the downward motion of the scissor-type unit 2. At the same time, the pivotal connections between the pivot connection unit 31 of the keycap 3 and the first frame 21 and the second frame 22 of the scissor-type unit 2 form dual fixed-rotation axes to effectively reduce ineffective transverse movement, such that the scissor-type unit 2 can move toward the base 1 nearly without producing ineffective vertical travel. In other words, such design can increase the effective vertical travel distance of the key module 100 compared to the effective vertical travel distance of the conventional key structure 1, such that the keycap 3 can stably and vertically move up and down with respect to the base 1 in a small range. According to one exemplified embodiment of the present disclosure, such as a super slim keyboard having a thickness of about 3.0 mm, when the vertical travel distance of the key module 100 is approximately 1 mm, the effective vertical travel distance of the scissor-type unit 2 can be approximately 0.9 mm-1 mm. In other words, the effective vertical travel distance of the movement of the scissor-type unit 2 toward the base 1 is nearly equal to the vertical travel distance of the movement of the key module 100. Therefore the key module 100 of the present disclosure is especially suitable for slim or super slim keyboards.

In summary, the present disclosure achieves the efficacy of moving the keycap 3 relative to the base 1 up and down vertically in a small range, therefore, creating keyboards having a super low-travel distance, by using the travel distance L of the movement of the connection shaft 211*a* within the shaft hole 221*a*, in conjunction with the rotatably pivotal connections of the first side 21*t* of the first frame 21 and the first side 22*t* of the second frame 22 to the pivot connection unit 31 of the keycap 3, and the slidable arrangements of the second side 21*e* of the first frame 21 and the second side 22*e* of the second frame 22 at the restricting unit 11 of the base 1. Additionally, when the key module 100 is pressed, the second side 21*e* of the first frame 21 slidably disposed at the restricting unit 11 and the second side 22*e* of the second frame 22 slidably disposed at the restricting unit 11 move away from each other, and therefore the force applied on the keycap 3 can be evenly distributed across the keycap 3, such that the keycap 3 can promptly drive the first frame 21 and the second frame 22 together to move toward the base 1 an effective vertical travel distance (which is also the vertical travel distance of the key module 100). Therefore, the key module 100 has the advantages of precise switch triggering and effective keycap pressing action. Moreover, since the pressing force is evenly distributed on the keycap 3, the keycap 3 is not liable to be tilted such that the keycap 3 can stably move up and down. Therefore, the keycap 3 presents a good solid touch when pressed at the center, the periphery or any position, and effectively reduces noise of operation. Therefore, the key module 100 of the present disclosure can create super slim keyboards having a vertical travel distance of approximately 0.70~1.50 mm, but the range of the vertical travel distance is not limited thereto.

As shown in FIG. 3 and FIG. 4, the present disclosure provides a key module 100 including a base 1, a scissor-type unit 2 and a keycap 3. The first frame 21 and the second frame 22 of the scissor-type unit 2 are pivotally connected to each other. The key module 100 may further include an elastic body 4 and a thin-film printed circuit board 5. The elastic body 4 is disposed between the keycap 3 and the base 1 for supporting the motion of the keycap 3 relative to the base 1. The thin-film printed circuit board 5 is disposed between the elastic body 4 and the base 1 for producing a trigger signal when pressed by the elastic body 4. Referring to FIG. 3 and FIG. 5, define an axis C for the connection shaft 211*a* of the first frame 21 and a midline A perpendicular to the axis C. The first frame 21 has two fixed-rotation shafts 212*a* on one side of the axis C and two sliding shafts 212*b* on the other side of the axis C (as shown in FIG. 3). The second frame 22 has two fixed-rotation shafts 222*a* on one side of the axis C and two sliding shafts 222*b* on the other side of the axis C. The two fixed-rotation shafts 212*a* of the first frame 21 define a fixed-rotating axis. The two sliding shafts 212*b* of the first frame 21 define a sliding axis. The two fixed-rotation shafts 222*a* of the second frame define a fixed-rotating axis. The two sliding shafts 22*b* of the second frame 22 define a sliding axis. The fixed-rotating axes of the first frame 21 and the second frame 22 are respectively rotatably pivotally connected to the underside of the keycap 3. The sliding axes of the first frame 21 and the second frame 22 are respectively slidably arranged on the base 1.

Referring to FIG. 3 and FIG. 4 again, the first frame 21 is a substantially rectangular body structure which has a circular opening 213 in the middle and includes two opposite first lateral walls 21*s*, and the first side 21*t* and the second side 21*e* opposite to each other. A respective connection shaft 211*a* protrudes from the middle of each of the first lateral walls 21*s*. The first side 21*t* and the second side 21*e* are connected to the two ends of the first lateral walls 21*s*. Two ends of the first side 21*t* are respectively formed with fixed-rotation shafts 212*a*, and two ends of the second side 21*e* are respectively formed with sliding shafts 212*b*. The fixed-rotation shaft 212*a* and the sliding shaft 212*b* are parallel to each other. The connection shaft 211*a* of the present embodiment is substantially a circular cylinder but is not limited thereto, and may be an elliptical cylinder. The second frame 22 is a substantially rectangular frame structure having a substantially rectangular opening in the middle for accommodating the first frame 21, and includes two opposite second lateral walls 22*s*, and the first side 22*t* and the second side 22*e* opposite to each other. The first side 22*t* and the second side 22*e* are connected to the two ends of the second lateral walls 22*s*. Two ends of the first side 22*t* are respectively formed with fixed-rotation shafts 222*a*, and two ends of the second side 22*e* are respectively formed with sliding shafts 222*b*. Through the pivotal connection of the connection shaft 211*a* to the shaft hole 221*a*, the first frame 21 and the second frame 22 are connected to form a complete scissor-type unit 2. The structure of the first frame 21 and the second frame 22 are not limited to that of the above description. Additionally, the arrangement of the connection shaft 211*a* and the shaft hole 221*a* respectively at the first frame 21 and the second frame 22 can be interchanged.

As shown in FIG. 4, the underside S of the keycap 3 has a pivot connection unit 31 including two first pivot connection portions 311 and two second pivot connection portions 312. The two first pivot connection portions 311 are pivotally connected to the two fixed-rotation shafts 212*a* of the first frame 21, and the two second pivot connection portions 312 are pivotally connected to the two fixed-rotation shafts 222*a* of the second frame 22, such that the fixed-rotation shaft 212*a* of the first frame 21 is rotatably pivotally connected to the corresponding first pivot connection portion 311 and the fixed-rotation shaft 222*a* of the second frame 22 is rotatably pivotally connected to the corresponding second pivot connection portion 312. Hence, the fixed-rotation shaft 212*a* of the first frame 21 and the fixed-rotation shaft 222*a* of the second frame 22 have a fixed distance L1 therebetween (namely the fixed distance between the first pivot connection portion 311 and the second pivot connection portion 312 of the pivot connection unit 31), and the pivotal connections between the pivot connection unit 31 of the keycap 3 and the scissor-type unit 2 forms dual fixed-rotation axes. As shown in FIG. 3, the base 1 can be formed with an L-shaped (but not limited to this shape) restricting unit 11 as a whole by stamping. The restricting unit 11 includes two first sliding connection portions 111 and two second sliding connection portions 112. The two first sliding connection portions 111 and the two second sliding connection portions 112 each pass upwardly through the thin-film printed circuit board 5 disposed on the base 1 and are respectively connected to the two sliding shafts 212*b* of the first frame 21 and the two sliding shafts 222*b* of the second frame 22, such that the two sliding shafts 212*b* of the first frame 21 are restricted and slidably disposed in the corresponding first sliding connection portions 111, and the two sliding shafts 222*b* of the second frame 22 are restricted and slidably disposed in the sliding connection portions 112. Hence, the two sliding shafts 212*b* of the first frame 21 and the two sliding shafts 222*b* of the second frame 22 have a variable distance L2 therebetween (namely the variable distance extending beyond the first sliding portions 111 and the second sliding portions 112 of the restricting unit 11). In the present embodiment, preferably, the base 1 has a first side F 1 and a second side F2 opposite to each other, the two first sliding connection portions 111 and the two sliding connection portions 112 are respectively disposed at the first side F1 and the second side F2, and an opening 111*a* of each first sliding connection portion 111 faces the first side F1 of the base 1, and an opening 112*a* of each second sliding connection portion 112 faces the second side F2 of the base 1.

Of particular note, the key module 100 of the present disclosure can be assembled automatically. For example, when the keycap 3 is to be assembled to the scissor-type unit 2 (the first frame 21 and the second frame 22 of the scissor-type unit 2 are already connected by pivotally connecting the connection shaft 211*a* to the shaft hole 221*a*), the two sliding shafts 212*b* of the first frame 21 and the two sliding shafts 222*b* of the second frame 22 may be first automatically placed level and aligned to the two first sliding connection portions 111 and the two sliding connection portions 112 of L-shaped and curved design on the base 1 (as shown in FIG. 7 minus the keycap 3). Then, the two first pivot connection portions 311 and the two second pivot connection portions 312 of the keycap 3 are pressed to be respectively engaged to the two fixed-rotation shafts 212*a* of the first frame 21 and the two fixed-rotation shafts 222*a* of the second frame 22 thereby quickly completing the assembly of the key module 100. Therefore, the assembly automation of the key module 100 of the present disclosure can effectively increase the assembly speed and production speed.

Of supplemental note, the present disclosure may have other modifications. For instance, the lateral wall structure of the first frame 21 and the second frame 22 may be properly modified. For example, the first frame 21 has only one sliding shaft 212 disposed at the middle of the second side 21*e*, and only one sliding groove is correspondingly arranged on the base 1. The design of coupling between the pivot connection portions 311, 312 of the keycap 3 of the key module 100 and the fixed-rotation shafts 212*a*, 222*a* of the scissor-type unit 2 is merely a preferred embodiment of the present disclosure, and is not used to limit the scope of the present disclosure. Any alteration or modification made within the scope of the present disclosure is under the protection scope of the present disclosure.

FIG. 6 shows a preferred embodiment of the present disclosure. As shown, the connection shaft 211*a* of the first frame 21 is exemplified by a circular shaft, the shaft hole 221*a* of the second frame 22 is preferably exemplified by an elliptical hole. However, the shapes of the connection shaft 211*a* and the shaft hole 221*a* are not limited thereto as long as the shaft hole 221*a* is elongated relative to the connection shaft 211*a* and guides the connection shaft 211*a* to move therein with substantially one degree of freedom. Therefore, the shaft hole 221*a* may also be rectangular or other shapes. The shaft hole 221*a* has a travel distance L therein provided for the connection shaft 211*a* to travel within the shaft hole 221*a* when the keycap 3 is pressed. Of particular note, the travel distance L is one of the key technical features for precise motion and suitability for super slim keyboards of the key module 100 of the present disclosure. The design of the travel distance L can be determined by the vertical travel distance of the key module 100 (also the height of the key module 100) and the dimensions of the scissor-type unit 2. Related description follows.

Refer to FIG. 6 and FIG. 7 describing the up and down motion of the key module 100 as the key module 100 is pressed and then returns to its original position. As shown in FIG. 6, when the key module 100 is not pressed, the keycap 3 of the key module 100 is positioned at a first height (H1). As shown in FIG. 7, when the key module 100 is pressed, the keycap 3 bears a downward force such that the elastic body 4 (referring to FIG. 3, omitted in FIG. 6 and FIG. 7) is deformed due to compression. At the same time, the first frame 21 and the second frame 22 of the scissor-type unit 2 swings accordingly. The connection shaft 211*a* moves from the first contact face U1 to the second contact face U2 , such that the first frame 21 and the second frame 22 moves downward toward the base 1 at the same time, and the elastic body 4 touches the thin-film printed circuit board 5 on the base 1 (referring to FIG. 3, omitted in FIG. 6 and FIG. 7) to produce a signal. At this time, the keycap 3 of the key module 100 is positioned at a second height (H2). The distance ΔH between the first height H1 and the second height H2 is the vertical travel distance ΔH of the key module 100. Next, when the keycap 3 is no longer being pressed, the keycap 3 is pushed upward due to the restoring force of the elastic body 4. The first frame 21 and the second frame 22 are driven by the keycap 3 to rotate. The connection shaft 211*a* returns from the second contact face U2 toward the first contact face U1. The keycap 3 moves to its original position prior to being pressed at a height substantially equal to the first height H1. The structural design of the key module 100 of the present disclosure 100 (that is, a travel distance provided between the connection shaft 211*a* and the shaft hole 221*a*, the pivotal connection of the upper sides of the first frame 21 and the second frame 22 to the pivot connection unit 31 and the slidable arrangement of the lower sides of the first frame 21 and the second frame 22 at the restricting unit 1) enables the keycap 3 to stably move up and down and is not easily tilted, and the keycap 3 presents a consistently solid touch when pressed either at the center, the periphery or any position. Therefore, the quality of the entire key module 100 is increased.

Of particular note, when the key module 100 of the present disclosure is pressed, as shown in FIG. 6, the connection shaft 211*a* of the first frame 21 moves from the first contact face U 1 to the second contact face U2 (the transverse motion of the connection shaft 211*a* amounts to a distance L). Since the fixed-rotation shaft 212*a* of the first frame 21 and the fixed-rotation shaft 222*a* of the second frame 22 connected to the keycap 3 have a constant distance L1 therebetween, the sliding shaft 212*b* of the first frame 21 slides from the corresponding opening 111*a* of the first sliding connection portion 111 toward the first side F1 of the base 1 (referring to FIG. 3), and the sliding shaft 222*b* of the second frame 22 slides from the corresponding opening 112*a* of the second sliding connection portion 112 toward the second side F2 of the base 1, such that the sliding shaft 212*b* of the first frame 21 and the sliding shaft 222*b* of the second frame 22 become further apart.

As shown in FIG. 7, in the present embodiment, during the downward pressing process of the keycap 3, the sliding shaft 212*b* of the first frame 21 slides a first distance D1 relative to the base 1, and the sliding shaft 222*b* of the second frame 22 slides a second distance D2 relative to the base 1.

Figure 8:
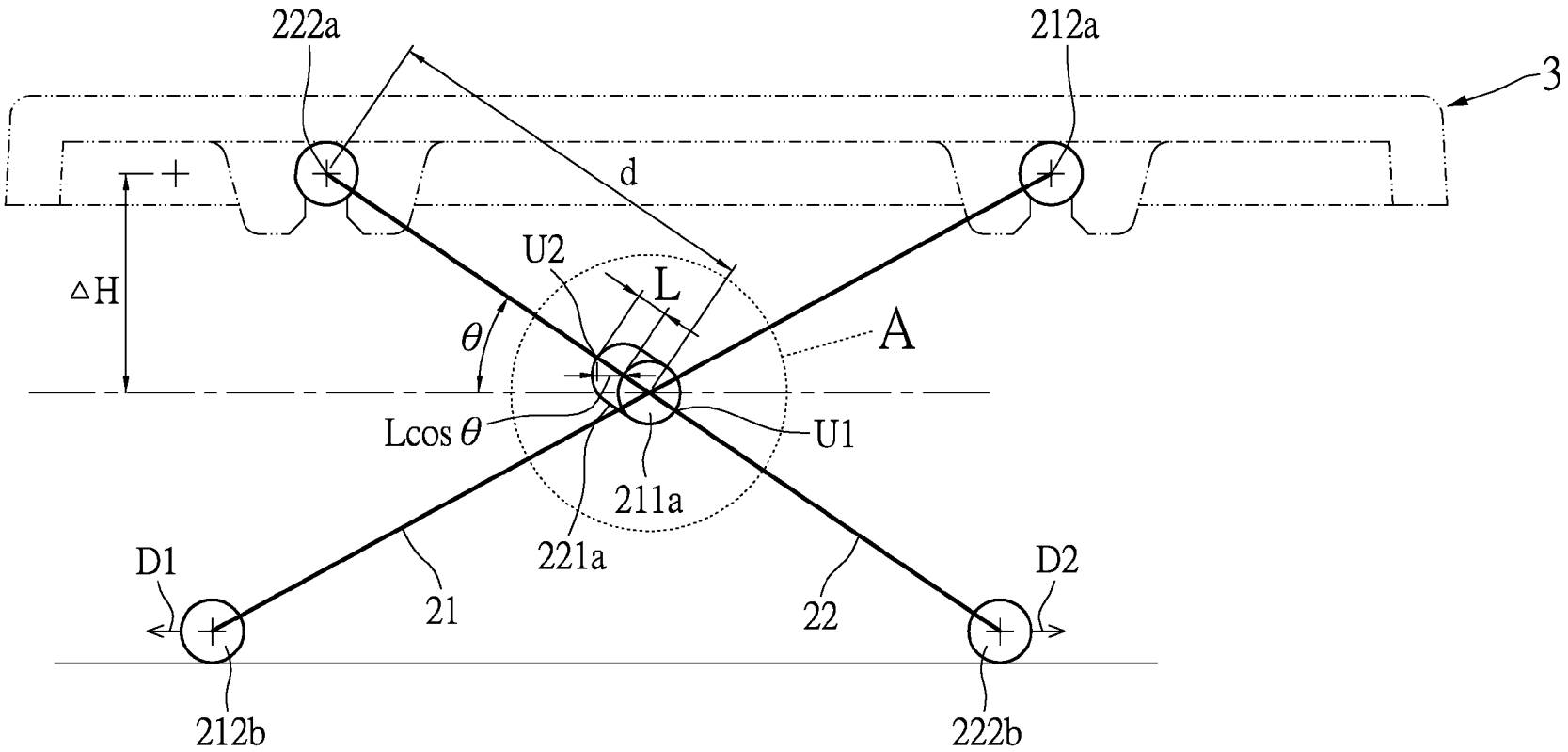
FIG. 8 shows a schematic diagram of the mechanical motion of a key module according to the present disclosure.
Figure 8A:
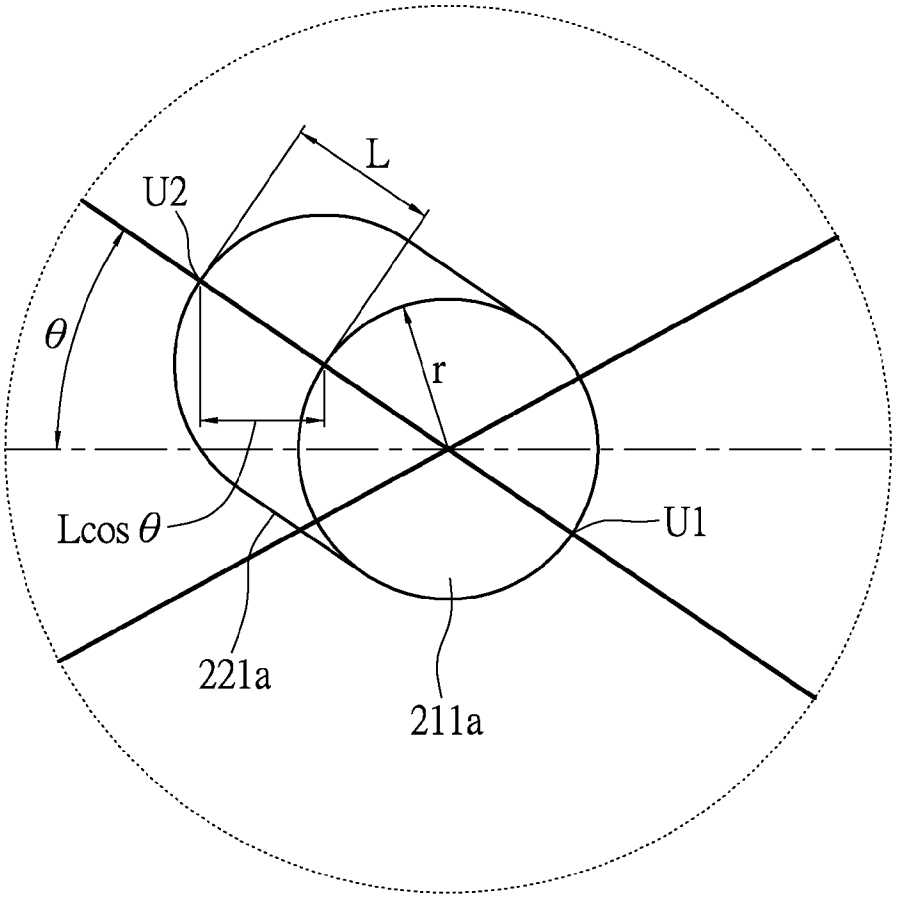
FIG. 8A shows an enlarged view of a portion of FIG. 8.

Referring to FIG. 8 and FIG. 8A, the following describes the minimum distance Lmin which the travel distance L must have. "d" is substantially half the length of the second frame 22 of the scissor-type unit 2 (which is the distance from the center axis of the connection shaft 211*a* of the first frame 21 to the center axis of the fixed-connection shaft 222*a*), and is a known design parameter. ΔH is the vertical travel distance of the keycap 3 (which is the distance between the first height of the unpressed keycap 3 and the second height of the pressed and substantially level keycap 3), and is a known design parameter. θ is an included angle between the second frame 22 and the horizontal plane.

The connection shaft 211*a* is designed to move a minimum travel distance Lmin, and allow the sliding shaft 212*b* of the first frame 21 and the sliding shaft 222*b* of the second frame 22 to transversely move with respect to the base 1 a first distance D1 and a second distance D2, respectively. Assume that the connection shaft 211*a* is substantially a circular shaft having a radius r.

$$\sin\theta=\Delta H/d\square 1/\sin\theta=d/\Delta H \quad (1);$$

$$(D1+D2)=L*\cos\theta \quad (2);$$

Combining formula (1) and formula (2), the following formula is obtained: Lmin=((D1+D2)*tan θ)*(d/ΔH). It must be noted that the above obtained formula is an example of a method for calculating Lmin. The method of calculating Lmin and the obtained formula of the present disclosure is not limited to the above.

Figure 1:
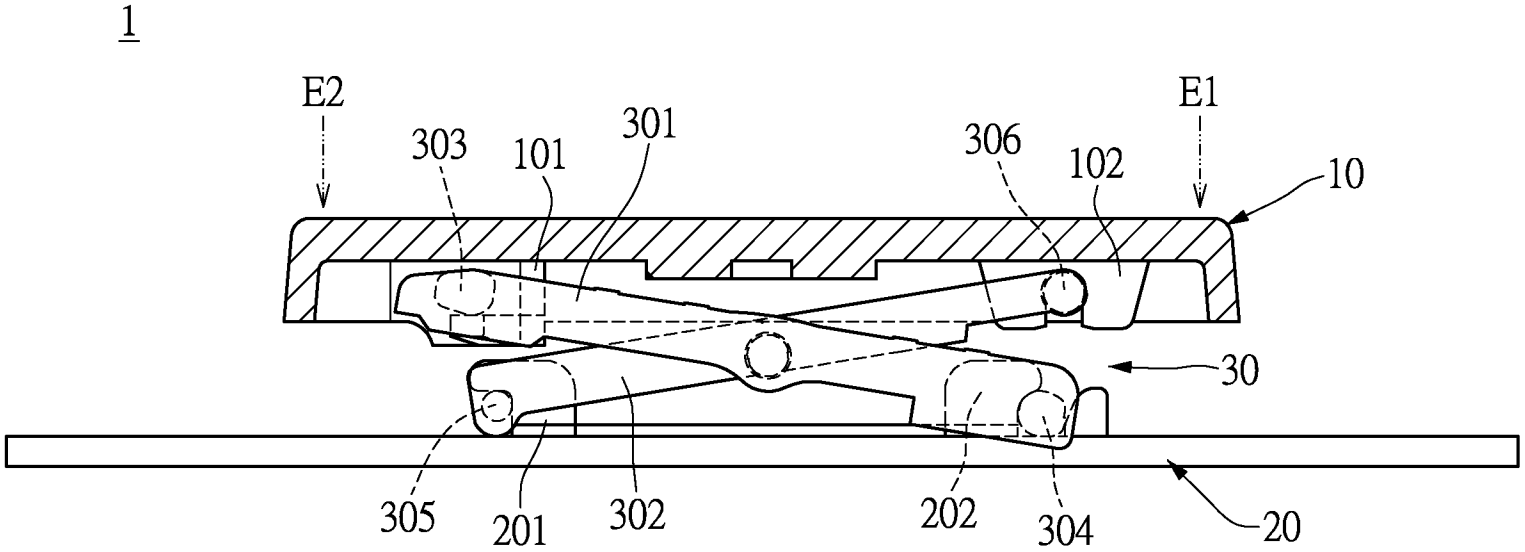
FIG.1 PRIOR ART
FIG. 1 shows a schematic diagram of a conventional key module.
Figure 1A:
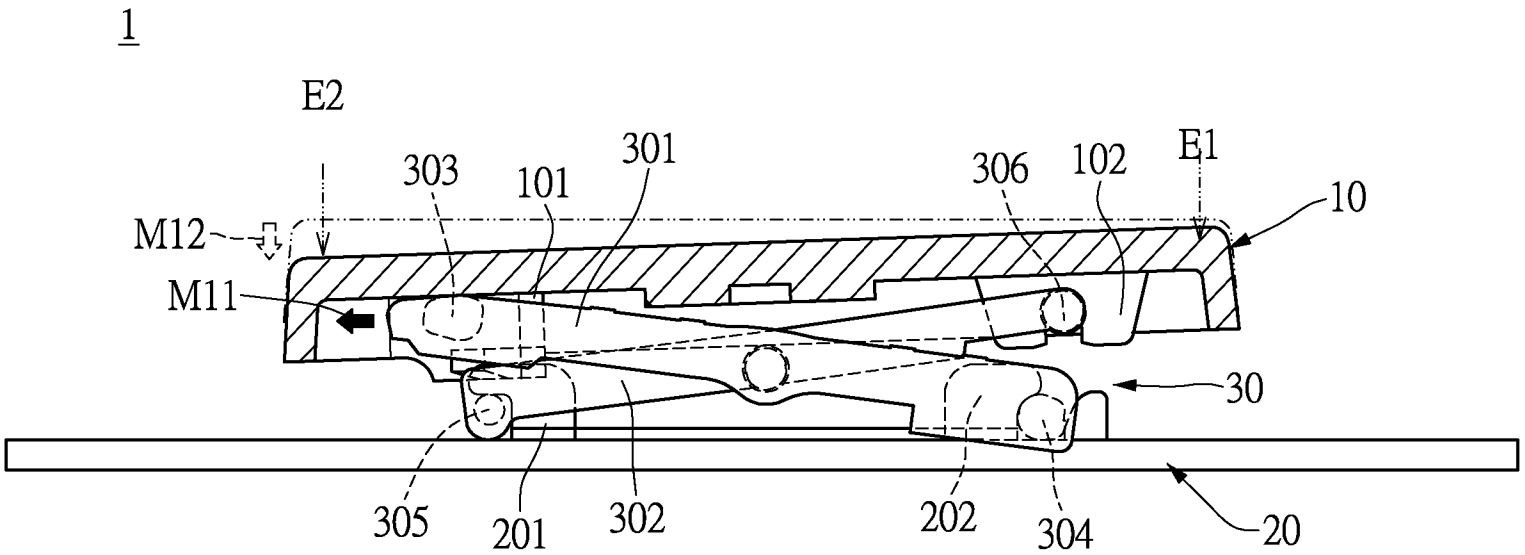
FIG.1A PRIOR ART
FIG. 1A shows a schematic diagram of a conventional key module when pressed.
Figure 2:
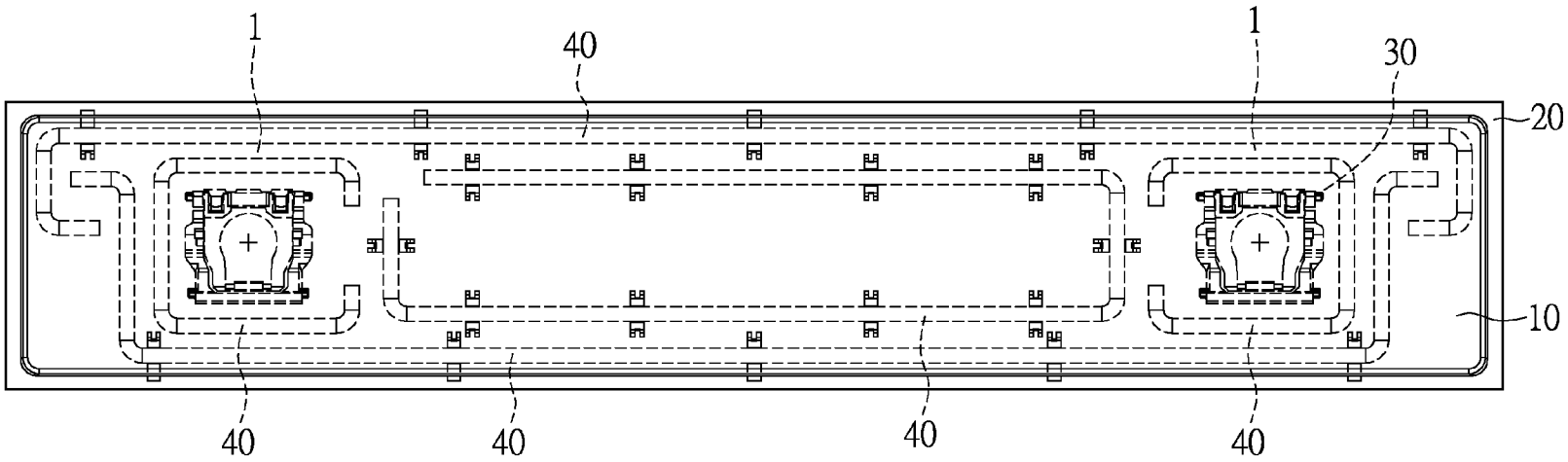
FIG.2 PRIOR ART
FIG. 2 shows a schematic diagram of another conventional key module.
Figure 9:
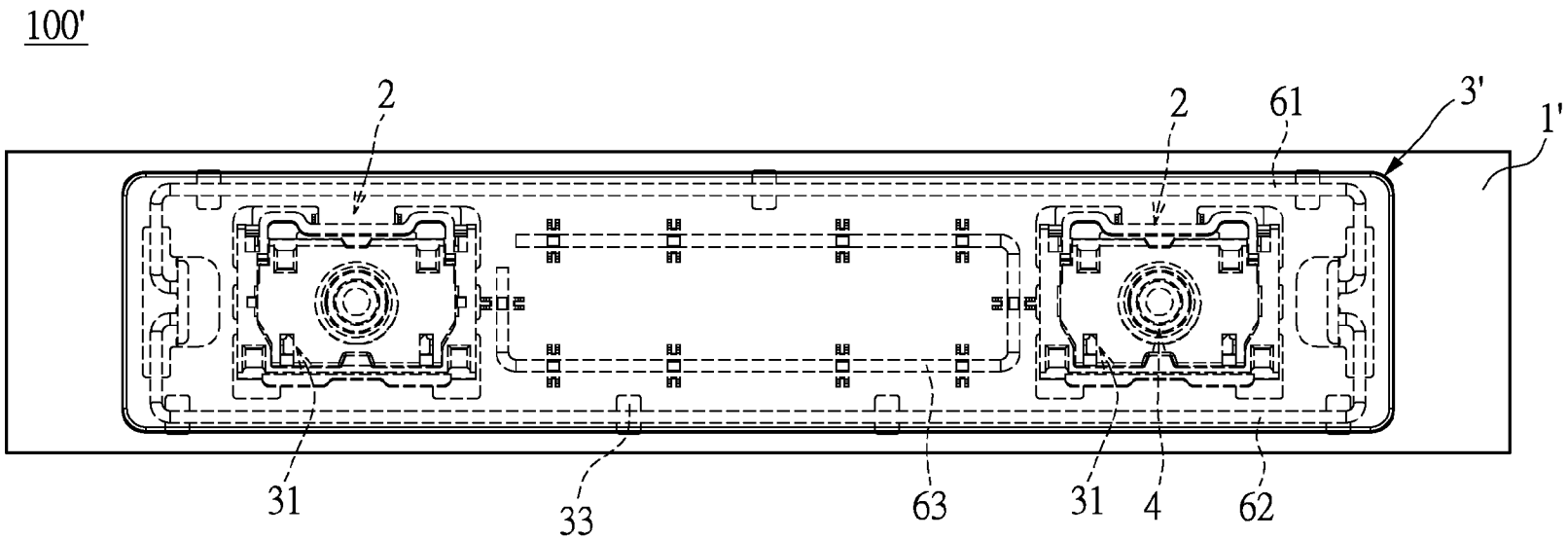
FIG. 9 shows a schematic diagram of a key module according to another embodiment of the present disclosure.

FIG. 9 shows a schematic diagram of a key module according to another embodiment 100' of the present disclosure. The key module 100' uses the structure of the key module 100 according to FIG. 3 to FIG. 5 (the scissor-type unit 2 is combined with the keycap 3' and the base 1') and has sufficient rigidity, so that the only stabilizer links 6 required are two first stabilizer links 61, 62 connected to the sides of the keycap and one stabilizer link 63 connected to the middle of the keycap 3. No additional stabilizer links are required at the periphery of the scissor-type unit 2. Compared to conventional technique, two fewer metal stabilizer links 40 are required (as shown in FIG. 2). Margin of error in the assembly of stabilizer links can result in defects such as misplacement of stabilizer links and damage to the keycap 3' and the base 1'. Therefore, the key module 100' of the present disclosure can reduce the rate of defects by 5%. Moreover, fewer stabilizer links results in less noise during operation, simpler assembly process, increased assembly efficiency and decreased labor cost. Additionally, the key module 100 has sufficient rigidity for supporting the keycap 3' to move vertically with respect to the base V. Therefore, compared to conventional technique (as shown in FIG. 2), the dimensions of the key module 100 do not need to be reduced, and the second stabilizer link 63 can be reduced in size to greatly reduce the difficulty of assembling the key module 100, to reduce material cost and production deficiencies, especially the keycap 3.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A key module, comprising:

a base having a restricting unit, wherein the restricting unit includes at least one first sliding connection portion and at least one second sliding connection portion, wherein the at least one first sliding connection portion forms an opening facing a first side of the base, wherein the at least one second sliding connection portion forms an opening facing a second side of the base opposite to the first side, wherein each of the sliding connection portions is L-shaped, and has a first portion erected relative to the base and a second portion bent from the first portion;

a scissor-type unit disposed on and connected to the base, and having a first frame and a second frame, wherein the first frame and the second frame each have two fixed-rotation shafts and at least one sliding shaft, wherein the first frame has a connection shaft, the second frame has a shaft hole, the first frame is rotatably connected to the second frame through an accommodation of the connection shaft in the shaft hole, and the shaft hole has a travel distance therein provided for the connection shaft to move within the shaft hole along a predetermined direction; wherein the connection shaft travels along the predetermined direction in the shaft hole with substantially one degree of freedom;

wherein the at least one sliding shaft of the first frame is restricted by and slidably disposed in the opening of the at least one first sliding connection portion on the base, wherein the at least one sliding shaft of the first frame is disposed on a top surface of the base;

wherein the at least one sliding shaft of the second frame is restricted by and slidably disposed in the opening of the at least one second sliding connection portion on the base, wherein the at least one sliding shaft of the second frame is disposed on a top surface of the base;

wherein the at least one sliding shaft of the first frame and the at least one sliding shaft of the second frame have a variable distance therebetween during the keycap is pressing; and a keycap disposed on and connected to the scissor-type unit, wherein the keycap has a pivot connection unit formed on a bottom surface thereof, wherein the pivot connection unit includes two first pivot connection portions and two second pivot connection portions;

wherein the two fixed-rotation shafts of the first frame are rotatably connected to the first pivot connection portions of the keycap;

wherein the two fixed-rotation shafts of the second frame are rotatably connected to the second pivot connection portions of the keycap;

wherein the fixed-rotation shafts of the first frame and the fixed-rotation shafts of the second frame connected to the keycap have a constant distance therebetween when the keycap is pressing;

wherein through the respective pivotal connections of the first side of the first frame and the first side of the second frame to the pivot connection unit, the respective slidable arrangement of the second side of the first frame and the second side of the first frame at the restricting unit, and the movement of the connection shaft within the shaft hole, the first frame rotates with respect to the second frame and the keycap moves up and down with respect to the base;

wherein when the keycap is downward pressed a maximum vertical travel distance, a distance from a bottom surface of the keycap to the top surface of the base is equal to a thickness of the second portion of a sliding connection portion and a diameter of the sliding shaft of the first frame.

2. The key module according to claim 1, wherein the shaft hole is an elongated groove having a first contact face and a second contact face opposite to each other, for guiding the connection shaft in the shaft hole to travel between the first contact face and the second contact face along the predetermined direction.

3. The key module according to claim 1, further comprising an elastic body and a thin-film printed circuit board, wherein the elastic body is disposed between the keycap and the base for supporting the keycap to move with respect to the base, and the thin-film printed circuit board is disposed between the elastic body and the base for producing a drive signal when pressed by the elastic body.

4. A keyboard comprising:

a base having a plurality of restricting units, wherein each of the restricting units includes at least one first sliding connection portion and at least one second sliding connection portion, wherein the at least one first sliding connection portion forms an opening facing a first side of the base, wherein the at least one second sliding connection portion forms an opening facing a second side of the base opposite to the first side, wherein each of the sliding connection portions is L-shaped, and has a first portion erected relative to the base and a second portion bent from the first portion;

a plurality of scissor-type units disposed on and connected to the base, and each having a first frame and a second frame, wherein the first frame and the second frame each have two fixed-rotation shafts and at least one sliding shaft, wherein each of the first frames has a connection shaft, each of the second frames has a shaft hole, each of the first frames is rotatably connected to one of the second frames through an accommodation of the respective connection shaft in the respective shaft hole, and the shaft hole has a travel distance therein provided for the connection shaft to travel within the shaft hole along a predetermined direction;

wherein the connection shaft travels along the predetermined direction in the shaft hole with substantially one degree of freedom;

wherein the at least one sliding shaft of the first frame is restricted by and slidably disposed in the opening of the at least one first sliding connection portion on the base, wherein the at least one sliding shaft of the first frame is disposed on a top surface of the base;

wherein the at least one sliding shaft of the second frame is restricted by and slidably disposed in the opening of the at least one second sliding connection portion on the base;

wherein the at least one sliding shaft of the first frame and the at least one sliding shaft of the second frame have a variable distance therebetween during the keycap is pressing, wherein the at least one sliding shaft of the second frame is disposed on a top surface of the base;

a plurality of keycap respectively disposed on and connected to the scissor-type units, and each of the keycaps has a pivot connection unit formed on a bottom surface thereof, wherein the pivot connection unit includes two first pivot connection portions and two second pivot connection portions;

wherein the two fixed-rotation shafts of the first frame are rotatably connected to the first pivot connection portions of the keycap;

wherein the two fixed-rotation shafts of the second frame are rotatably connected to the second pivot connection portions of the keycap;

wherein the fixed-rotation shafts of the first frame and the fixed-rotation shafts of the second frame connected to the keycap have a constant distance therebetween when the keycap is pressing;

a plurality of elastic bodies respectively disposed at the undersides of the keycaps; and a thin-film printed circuit board disposed on the base and corresponding to the keycaps;

wherein through the respective pivotal connections of the first sides of the first frames and the first sides of the second frames to the pivot connection units, the respective slidable arrangement of the second sides of the first frames and the second sides of the first frames at the restricting units, and the movements of the connection shafts within the shaft holes, the first frames rotate with respect to the respective second frames and the keycaps move up and down with respect to the base, and the elastic bodies press the thin-film electric circuit board on the base for producing signals;

wherein when the keycap is downward pressed a maximum vertical travel distance, a distance from a bottom surface of the keycap to the top surface of the base is equal to a thickness of the second portion of a sliding connection portion and a diameter of the sliding shaft of the first frame or the second frame.

5. The keyboard according to claim 4, wherein each of the shaft hole is an elongated groove having a first contact face and a second contact face opposite each other, for guiding the respective connection shaft in the shaft hole to move between the first contact face and the second contact face along the predetermined direction.

* * * * *